US010422160B2

(12) United States Patent
Widén

(10) Patent No.: US 10,422,160 B2
(45) Date of Patent: Sep. 24, 2019

(54) CYLINDER LOCK AND KEY COMBINATION WITH A DUAL TUMBLER ASSEMBLY AND A KEY THEREFORE

(71) Applicant: WINLOC AG, Zug (CH)

(72) Inventor: Bo Widén, Torshälla (SE)

(73) Assignee: WINLOC AG, Zug (CH)

( * ) Notice: Subject to any disclaimer, the term of this patent is extended or adjusted under 35 U.S.C. 154(b) by 0 days.

(21) Appl. No.: 14/773,797

(22) PCT Filed: Mar. 20, 2014

(86) PCT No.: PCT/SE2014/050337
§ 371 (c)(1),
(2) Date: Sep. 9, 2015

(87) PCT Pub. No.: WO2014/148994
PCT Pub. Date: Sep. 25, 2014

(65) Prior Publication Data
US 2016/0017637 A1 Jan. 21, 2016

(30) Foreign Application Priority Data
Mar. 20, 2013 (SE) ..... 1350346

(51) Int. Cl.
*E05B 27/00* (2006.01)
*E05B 19/00* (2006.01)
*E05B 27/10* (2006.01)

(52) U.S. Cl.
CPC ..... *E05B 27/005* (2013.01); *E05B 19/0023* (2013.01); *E05B 27/0021* (2013.01);
(Continued)

(58) Field of Classification Search
CPC ..... E05B 27/005; E05B 27/0057; E05B 27/0032; E05B 27/0042; E05B 27/0021;
(Continued)

(56) References Cited

U.S. PATENT DOCUMENTS 917,365 A * 4/1909 Schoell ..... E05B 27/0021 70/359
1,095,500 A * 5/1914 Hansen ..... E05B 27/0021 70/359

(Continued)

FOREIGN PATENT DOCUMENTS

DE 3119626 C2 7/1986
EP 0625624 B1 11/1994

(Continued)

OTHER PUBLICATIONS

International Search Report, issued in PCT/SE2014/050337, dated Jun. 27, 2014.

(Continued)

*Primary Examiner* — Lloyd A Gall
(74) *Attorney, Agent, or Firm* — Birch, Stewart, Kolasch & Birch, LLP

(57) ABSTRACT

A cylinder lock and key combination with a key slot and at least one dual tumbler assembly for locking a key plug against rotation. The dual tumbler assembly includes an outer pin movable elevationally in a chamber in the key plug, and an inner pin movable telescopically in a cylindrical bore in the outer pin. The outer pin is provided with at least one key contacting end portion for engagement with a first code portion of a key blade upon insertion thereof in the key slot. The inner pin is provided with at least one key contacting end portion, for engagement with a second code portion of the key blade. The key contacting end portions of the outer and inner pins of the tumbler assembly are located adjacent to each other at axially and radially well-defined code positions relative to a center-line of the tumbler assembly.

15 Claims, 8 Drawing Sheets

(52) U.S. Cl.
CPC ..... *E05B 27/0032* (2013.01); *E05B 27/0042* (2013.01); *E05B 27/0078* (2013.01); *E05B 19/0058* (2013.01); *E05B 27/0057* (2013.01); *E05B 2027/0025* (2013.01); *E05B 2027/10* (2013.01)

(58) Field of Classification Search
CPC ..... E05B 27/0078; E05B 2027/10; E05B 2027/0025; E05B 27/0039; E05B 27/02; E05B 19/0023; E05B 19/0058; E05B 19/0064; E05B 19/0017; Y10T 70/7571; Y10T 70/7605; Y10T 70/7881
USPC ..... 70/419, 421, 358, 359, 409, 493–496, 70/378, DIG. 21, DIG. 22, DIG. 25, 70/DIG. 37
See application file for complete search history.

(56) References Cited

U.S. PATENT DOCUMENTS

| | | | | | |
|---|---|---|---|---|---|
| 1,244,304 | A * | 10/1917 | Epstein | E05B 27/0017 | 70/359 |
| 1,257,987 | A * | 3/1918 | Epstein | E05B 27/0017 | 70/359 |
| 3,818,732 | A * | 6/1974 | Tria, Jr. | E05B 27/0021 | 70/359 |
| 4,856,309 | A * | 8/1989 | Eizen | E05B 27/0021 | 70/359 |
| 5,067,335 | A * | 11/1991 | Widen | E05B 27/0082 | 70/358 |
| 5,123,268 | A * | 6/1992 | Eizen | E05B 27/0021 | 70/359 |
| 5,222,383 | A * | 6/1993 | Fann | E05B 27/0021 | 70/358 |
| 5,894,750 | A * | 4/1999 | Liaw | E05B 27/0021 | 70/338 |
| 5,964,112 | A * | 10/1999 | Stefanescu | E05B 19/0017 | 70/358 |
| 5,966,971 | A * | 10/1999 | Keller | E05B 27/0021 | 70/359 |
| 7,086,259 | B2 * | 8/2006 | Almoznino | E05B 27/0021 | 70/359 |
| 8,950,226 | B2 * | 2/2015 | Dolev | E05B 27/0017 | 70/395 |
| 2007/0028658 | A1 | 2/2007 | Widen | | |
| 2009/0193862 | A1 | 8/2009 | Alcela Y Bea et al. | | |
| 2011/0219833 | A1 * | 9/2011 | Widen | E05B 27/0017 | 70/491 |

FOREIGN PATENT DOCUMENTS

| | | | |
|---|---|---|---|
| EP | 0784138 | B1 | 7/1997 |
| GB | 2453626 | A | 4/2009 |
| WO | WO 98/05838 | A1 | 2/1998 |
| WO | WO 2010/026381 | A1 | 3/2010 |

OTHER PUBLICATIONS

Written Opinion of the International Searching Authority, issued in PCT/SE2014/050337, dated Jun. 27, 2014.

* cited by examiner 10
30
15
20
50

11
10
12
12
12
12b
12
12a
51f
50
C
52
51b
51
50
52b
51d
51c
51a 10
12
12
12b
12a
11

12b
51b
51f
52b
51
52
CL
51f 51b
51
50
52b
52
11
10

52
50
51
10´
11´
12
12
12
12
12b
12a
C
C 52
50
51
10´
11´

12´b
52
51

10´
11´
12´
12´
12´

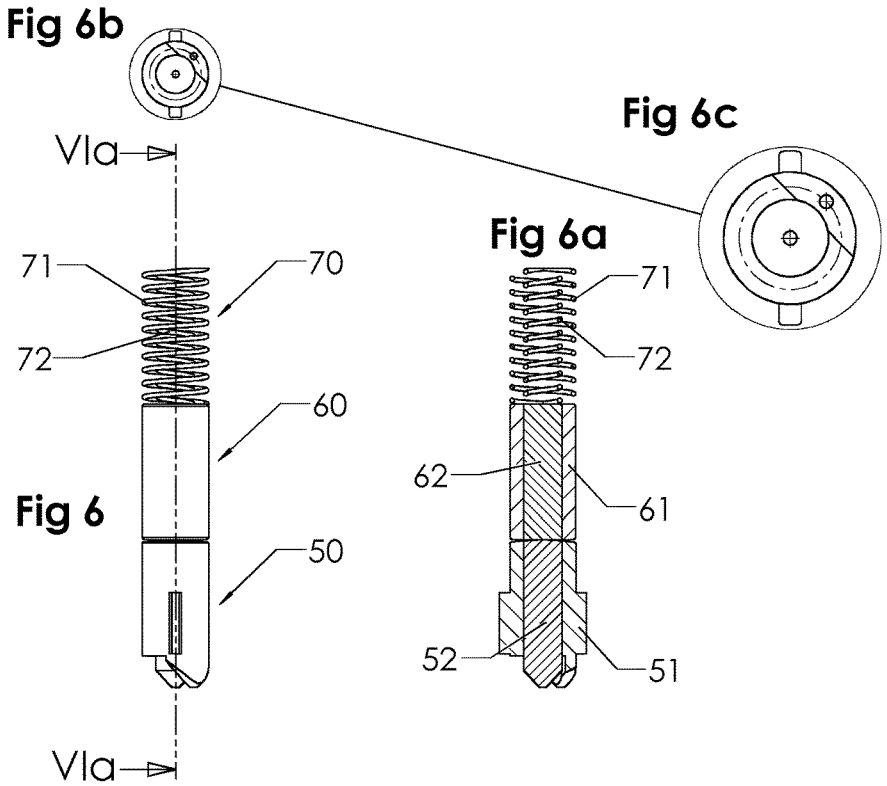
Fig 6b
Fig 6c
VIa
71
70
72
60
Fig 6
50
VIa
Fig 6a
71
72
62
61
52
51
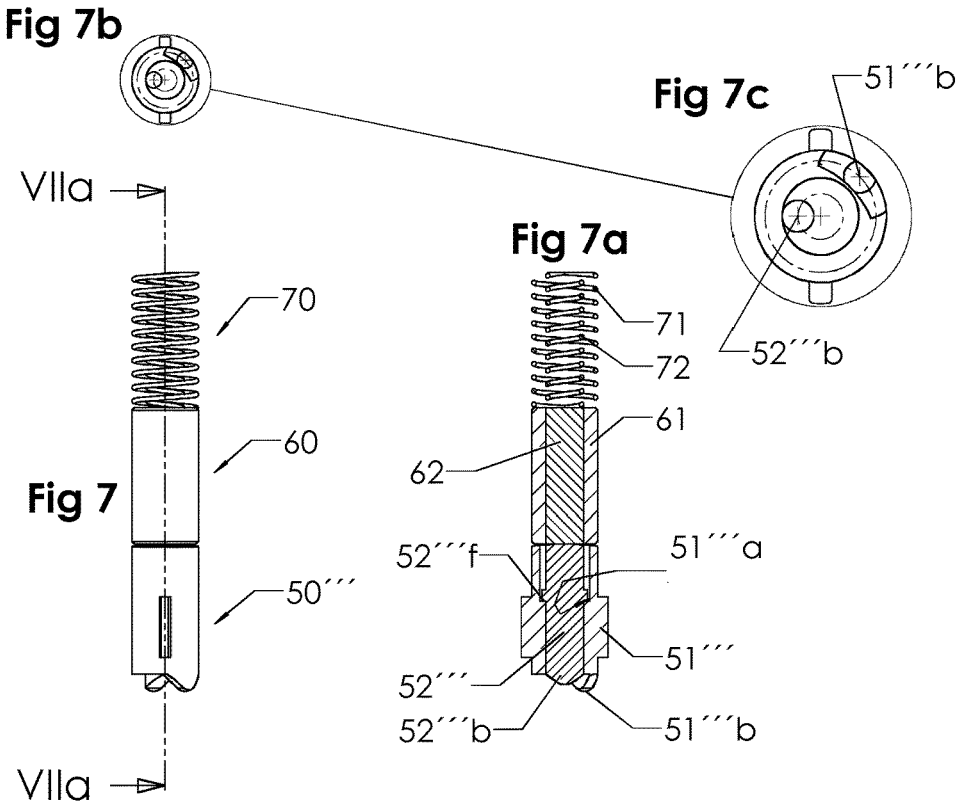
Fig 7b
Fig 7c
51´´´b
VIIa
Fig 7a
70
71
72
52´´´b
61
60
62
Fig 7
52´´´f
51´´´a
50´´´
51´´´
52´´´
52´´´b
51´´´b
VIIa

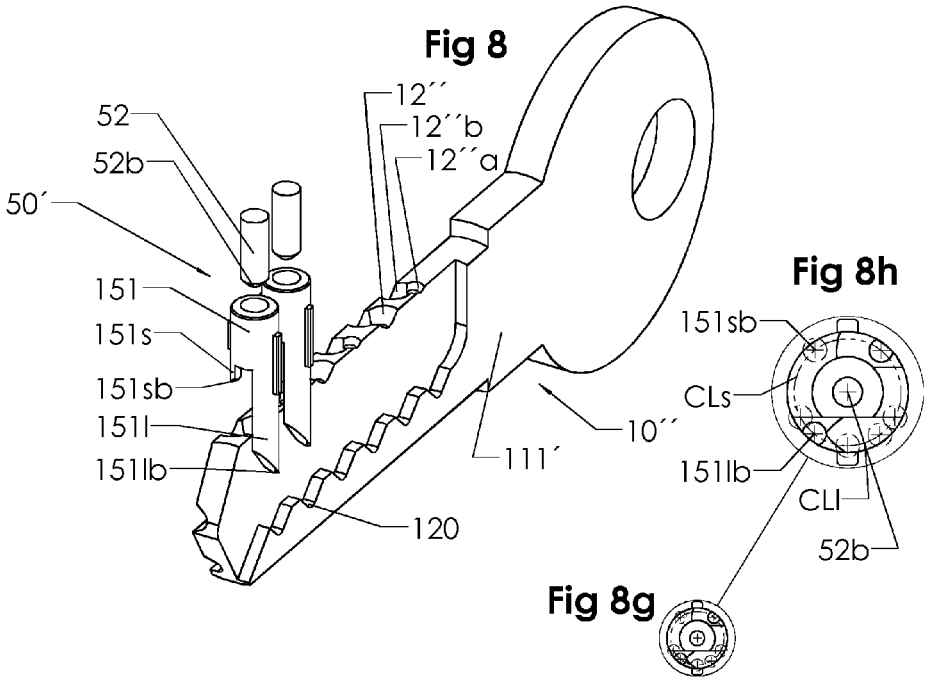
Fig 8
52
52b
50´
151
151s
151sb
151l
151lb
12´´
12´´b
12´´a
10´´
111´
120
Fig 8h
151sb
CLs
151lb
CLl
52b
Fig 8g
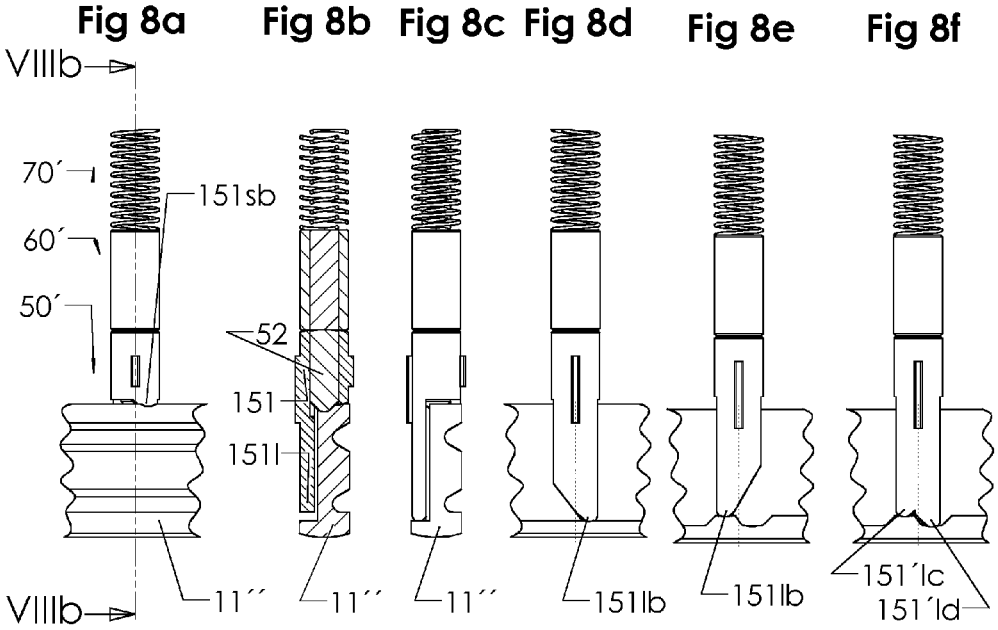
Fig 8a
Fig 8b
Fig 8c
Fig 8d
Fig 8e
Fig 8f
VIIIb
70´
60´
50´
151sb
52
151
151l
11´´
151lb
151´lc
151´ld
VIIIb Fig 9f
Fig 9e
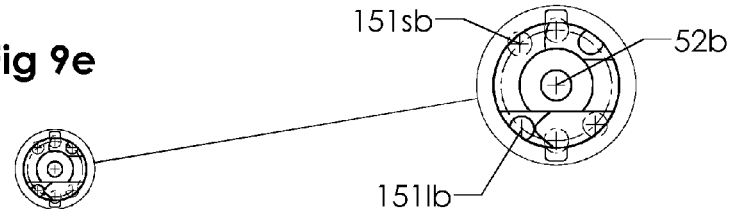
Fig 9a
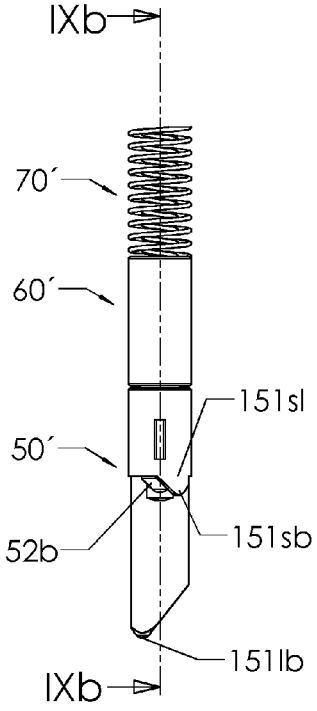
Fig 9b
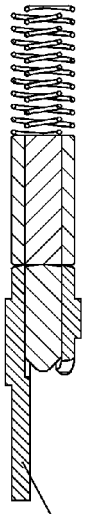
Fig 9c
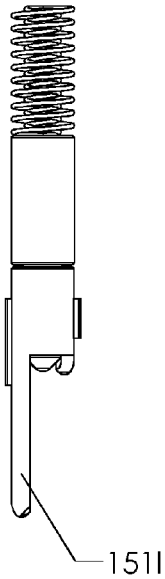
Fig 9d
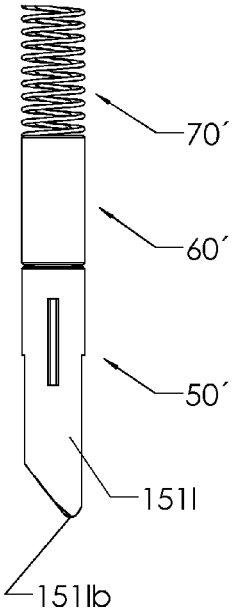

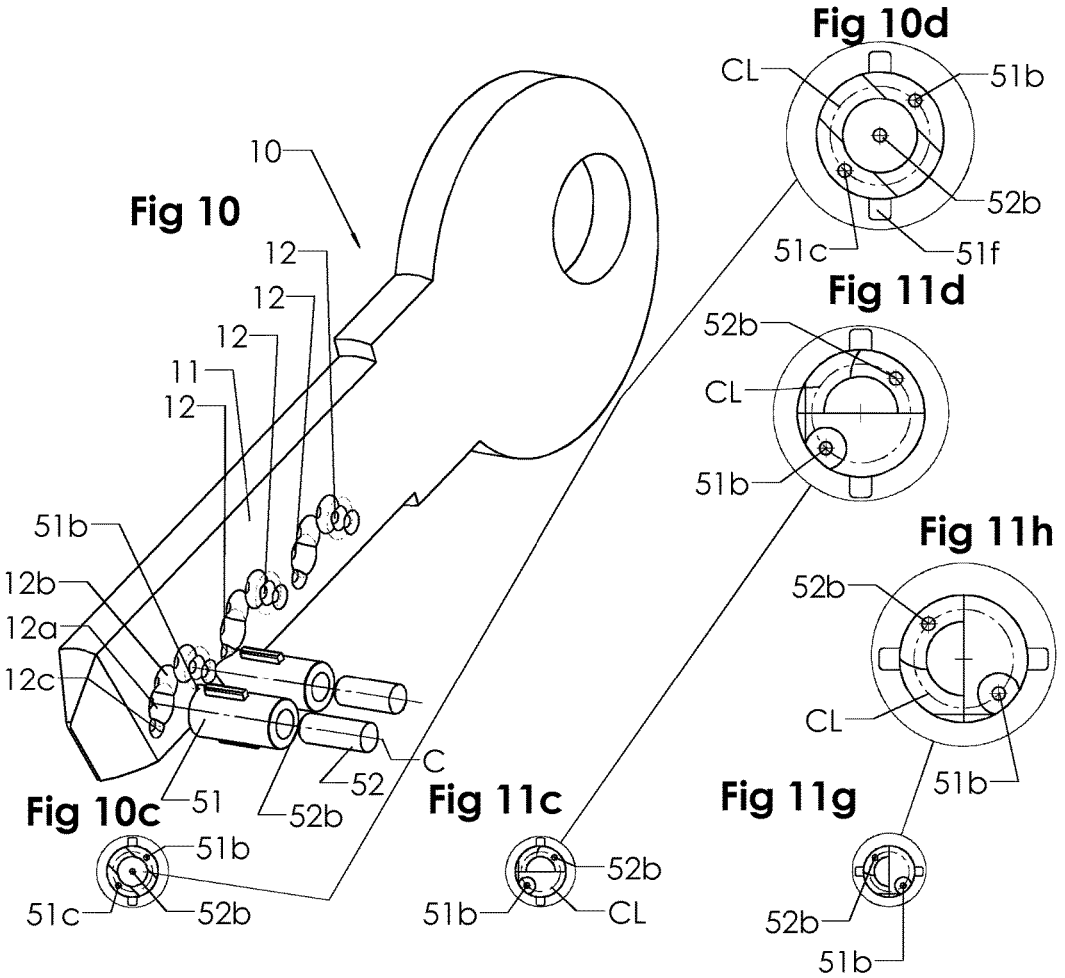
Fig 10
10
12
12
12
11
12
51b
12b
12a
12c
C
52
51
52b
Fig 10c
51b
51c
52b
Fig 10d
CL
51b
52b
51c
51f
Fig 11d
52b
CL
51b
Fig 11c
52b
51b
CL
Fig 11h
52b
CL
51b
Fig 11g
52b
51b
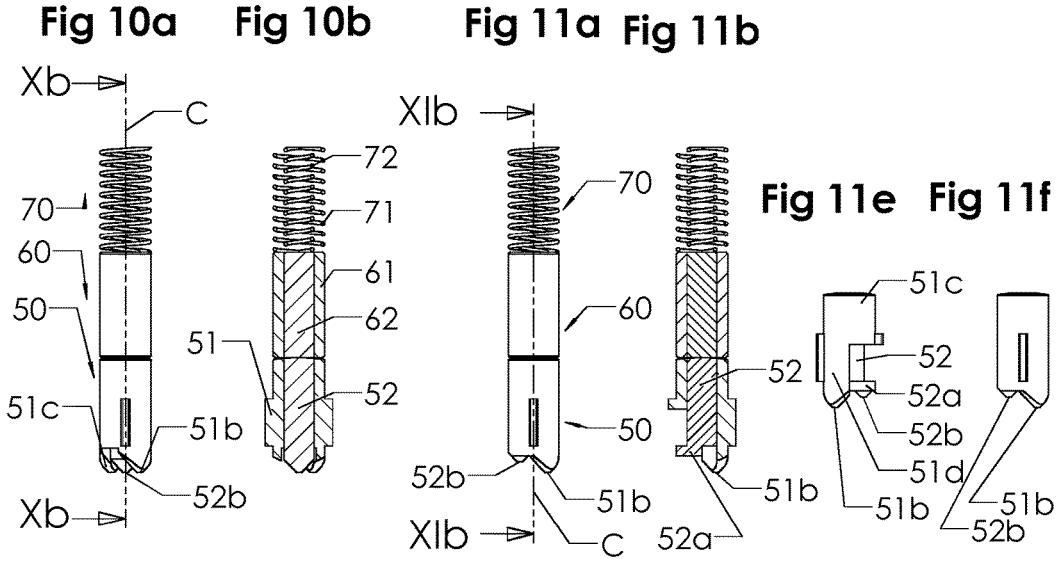
Fig 10a
Fig 10b
Fig 11a
Fig 11b
Xb
C
70
60
50
51c
51b
52b
Xb
72
71
61
62
51
52
XIb
70
60
50
52b
51b
XIb
C
52
51b
52a
Fig 11e
Fig 11f
51c
52
52a
52b
51d
51b
51b
52b

CYLINDER LOCK AND KEY COMBINATION WITH A DUAL TUMBLER ASSEMBLY AND A KEY THEREFORE

FIELD OF THE INVENTION

The present invention relates to a cylinder lock and key combination, comprising

- a key with an elongate key blade, and
- a lock having a rotatable key plug with a key slot and at least one dual tumbler assembly for locking the key plug against rotation, including
- an outer pin which is movable elevationally in a chamber in the key plug, and
- an inner pin, which is movable telescopically in a central cylindrical bore in said outer pin,
- said outer pin being provided with at least one key contacting end portion for engagement with a first code portion of said key blade upon insertion thereof into the key slot of the lock,
- said inner pin also being provided with at least one key contacting end portion, for engagement with a second code portion of said key blade,
- said first and second code portions of the key blade defining specific code patterns on said key blade, one code pattern for each tumbler assembly, and
- each such code pattern comprising adjacent code portions corresponding to the locations and depths of said first and second key contacting end portions of an associated tumbler assembly.

The invention also relates to a key for use in such a lock and key combination.

BACKGROUND OF THE INVENTION AND PRIOR ART

In prior art technology, there are many examples of cylinder lock and key combinations of the kind referred to above, having telescopic tumbler assemblies with outer pins and inner pins. In one example, disclosed in WO98/5838 (Mul-T-Lock), each tumbler assembly comprises a principle pin and a plurality of peripheral pins arranged to fit in the principle pin in a selectable non-coaxial arrangement therewith. Such a combination is quite complex, with at least three pins in each tumbler assembly, and a corresponding number of auxiliary components, such as springs and corresponding pins in the lock surrounding the rotatable key plug (denoted tumbler in this document).

Another example is an embodiment disclosed in GB 2453626 A (ASSA ABLOY Ltd.), where each telescopic tumbler pin assembly comprises an outer pin in which an inner pin is slidably mounted. The key contacting end portion of the outer pin is formed as a sleeve with a cylindrical shape having a uniform end surface. This end surface is frustro-conical, so as to provide a sliding engagement with a correctly cut key blade. The inner pin, on the other hand, has a rounded or pointed end portion, the axial position of which provides a key code. For each tumbler assembly, the code on the key blade is constituted by the axial positions of an annular seating surface (engaging with the cylindrical end portion of the outer pin) and a central dome-like projection (providing a coded seat for the end portion of the inner pin).

OBJECT OF THE INVENTION

Against this background, the object of the present invention is to provide a telescopic tumbler assembly having a relatively simple structure, with only a few parts, and still offering a very high number of code combinations.

SUMMARY OF THE INVENTION

According to the invention, there is provided a cylinder lock and key combination with at least one tumbler assembly having an outer pin and an inner pin, wherein the code position of the at least one key contacting end portion of the outer pin is defined by an axially displaced portion situated at a circumferentially coded location along a circle having its centre on said centre-line of said dual tumbler assembly.

In this way, the number of codes which can be obtained for each tumbler assembly is very large, a first degree of freedom being the axial position of the end portion of the inner pin, a second degree of freedom being the circumferential position of the axially displaced portion of the outer pin and a third degree of freedom being the axial position of the axially displaced portion of the outer pin. Moreover, the outer pin may be provided with two or more axially displaced portions. In such embodiments, the tumbler assembly is provided with at least three key contacting end portions, making the number of possible code combinations even greater.

In spite of the great number of code combinations, the structure of each tumbler assembly is relatively simple and easy to manufacture.

The invention also provides a key for use in a lock and key combination, with at least one code pattern comprising a code portion configured to receive the key contacting portion of an inner pin and at least one further code portion, located at a circumferentially coded position at a radial distance from a centre point of the code pattern for receiving a corresponding axially displaced portion of the outer pin.

The "axially displaced portion" of the outer pin may be an axially projecting lug, or an axially extending recess.

A number of suitable embodiments will appear from the detailed description below and the appended claims, including various dependent claims relating to different embodiments.

BRIEF DESCRIPTION OF THE DRAWINGS

The invention will now be described in more detail below, with reference to the drawings.

FIG. 6 shows a tumbler assembly, similar to the one shown in FIG. 3, and an axially adjoining drive pin assembly to be arranged in a lock housing (not shown) surrounding the rotatable key plug where the tumbler assembly is located;

FIG. 6*a* is a longitudinal section through the assembly shown in FIG. 6;

FIGS. 6*b* and 6*c* are top views of the assembly of FIG. 6, the FIG. 6*c* being drawn to a larger scale;

FIGS. 7, 7*a*, 7*b* and 7*c* are views, similar to those of FIGS. 6, 6*a*, 6*b* and 6*c*, of a modified embodiment of the tumbler assembly, with an inner pin having an asymmetric key contacting lug;

FIGS. 8, 8*a*, 8*b*, 8*c*, 8*d*, 8*e*, 8*f*, 8*g* and 8*h* illustrate a key with a key blade having two different code patterns, and tumbler assemblies each having an outer pin with a long part and a short part cooperating respectively with the two code patterns on the key, the FIGS. 8*d*, 8*e* and FIG. 8*f* illustrating three different embodiments;

FIGS. 9*a*, 9*b*, 9*c*, 9*d*, 9*e* and 9*f* illustrate the tumbler assembly only, the embodiment being the same as the one shown also in FIGS. 8*a*, 8*b*, 8*c* and 8*d*, without the associated key;

FIGS. 10, 10*a*, 10*b*, 10*c* and 10*d* illustrate a further embodiment of a key and associated tumbler assemblies, where the outer pin is provided with two axially projecting lugs;

FIGS. 11*a*, 11*b*, 11*c*, 11*d*, 11*e*, 11*f*, 11*g* and 11*h* illustrate a further embodiment where the inner pin is offset radially from the centre-line of the tumbler assembly.

DETAILED DESCRIPTION OF PREFERRED EMBODIMENTS

Figures 1, 1A, 1B, 1C, 1D:
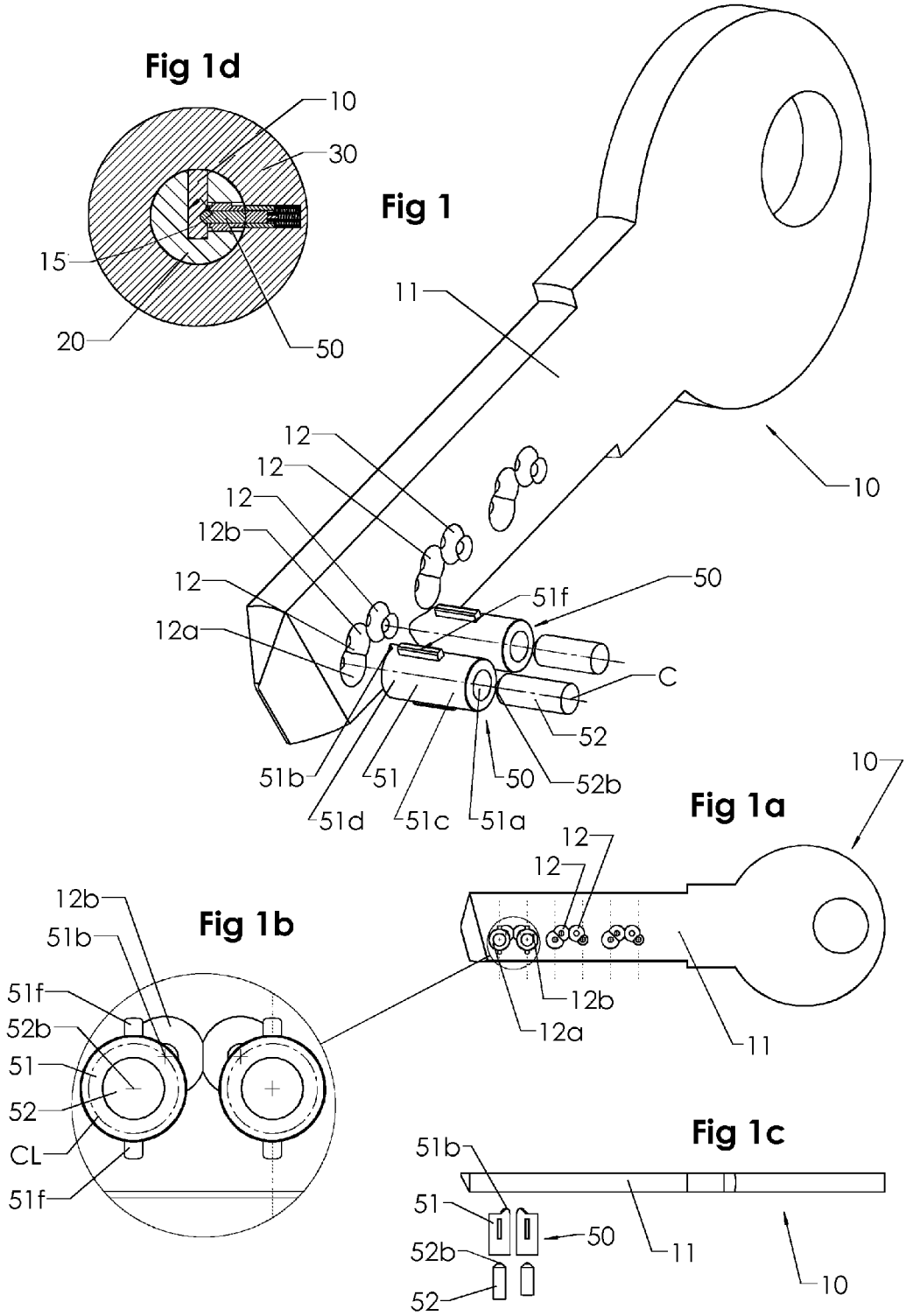
FIG. 1 and FIG. 1*a* illustrate, in a perspective view and a side view, respectively, a key according to the invention, with two tumbler assemblies being schematically illustrated in FIG. 1.
FIG. 1*b* shows, in a larger scale, a portion of the code pattern on the key of FIG. 1*a;*
FIG. 1*c* is a top view of the key and tumbler assembly shown in FIG. 1.
FIG. 1*d* is a cross-section through a lock with a key plug accommodating the key and the tumbler assemblies shown in FIG. 1.

In FIGS. 1, 1*a*, 1*b* and 1*c*, there is shown a key 10 with a key blade 11. The key blade 11 is elongate and, in the illustrated embodiment, generally flat. Although not shown explicitly, the key blade is normally provided with profiled ribs and grooves so as to fit in a corresponding profiled keyway in a lock (FIG. 1*d*). The key blade 11 is provided with a number of code patterns 12, each such code pattern 12 cooperating with a corresponding tumbler assembly 50.

According to the present invention, a new kind of tumbler assembly 50 is used. Normally, there is a row of such tumbler assemblies being arranged in a row of cylindrical bores, adjacent to a key slot 15, in a rotatable key plug 20 of an associated lock, with a housing 30, as illustrated schematically in FIG. 1*d*. The lock itself may be of a general kind well known to those skilled in the art.

The new kind of dual tumbler assembly 50 comprises an outer pin 51 and an inner pin 52, which is movable telescopically in an axial bore 51*a* in the outer pin 51. Both the outer pin 51 and the inner pin 52 have axially protruding key contacting end portions which engage with the associated code pattern 12 on the key blade. The inner pin 52 has a key contacting end portion in the form of a conical pointed lug 52*b*, which in this embodiment is located on the centre-line C of the tumbler assembly. As will appear below, this pointed lug 52*b* can alternatively be asymmetrically located in relation to the centre-line C.

The outer pin 51 is composed of a first or upper part 51*c*, provided with the bore 51*a*, at the inside thereof, and a second or lower part 51*d*, which is provided with an axially displaced end portion, in this embodiment in the form of an axially projecting lug 51*b*. This axially displaced end portion or projecting lug 51*b* is situated at a circumferentially coded position at a radial distance from the centre-line C so as to engage with an associated code portion, in this embodiment in the form of a recess portion 12*b* in the associated code pattern 12 on the key blade 11.

In FIG. 1*b* there are shown, schematically, the coded locations configured to receive the axial lugs 51*b*, 52*b*, serving as key contacting portions. Thus, the conical lug 52*b* of the inner pin 52 is, in this embodiment, located on the centre-line C, and the possible code variations for this key contacting portion is the axial position on the centre-line. Normally, this axial position, or depth, may be defined at two, three or four different levels.

The axially projecting lug 51*b* on the outer pin 51, on the other hand, may be positioned at any coded location along the dash-dotted circle CL. For practical reasons, there should be four to twelve possible positions corresponding to a mutual angular difference of 90° to 30°. Of course, the axial length or depth of the lug 51*b* may also be coded into 2-4 different levels. These coded variations will correspond to various axial depths of the code recess portion 12*a* and a multitude of variations for the coded recess portion 12*b*, including axial depth variations as well as angular positions as indicated above.

In order to retain the exact angular position of the axial lug 51*b* on the outer pin 51, it is of course essential that the outer pin 51 is maintained in an angular or rotational position in the associated bore in the key plug of the lock. This is achieved by the radially outwardly projecting members or fins 51*f* which are guided in associated grooves along the bores of the key plug.

As will be explained further below, the exact structure of the tumbler assembly 50 may be modified in many ways. However, in all embodiments, there is a combination of an inner pin with an axially projecting lug 52*b* (or axial recess) and an outer pin 51 with at least one axially projecting lug 51*b* (or axial recess), the position of the lug 52*b* or recess being coded axially, and the position of the axial lug 51*b* (or recess) being coded circumferentially (up to 12 or even more positions) as well as axially. Accordingly the number of code combinations for one tumbler assembly 50 is very great, e.g. 48 if there are two axial positions for each lug or recess and 108 if there are three axial positions for each lug or recess.

As appears from FIGS. 2, 2*a*, 2*b* and 2*c*, it is possible to locate the code pattern on the edge portion of the key blade, rather than on one or two of the sides of the key blade. In this embodiment, the tumbler assemblies 50 are oriented with their centre-lines extending in a central plane of the relatively flat key blade 11' of the key 10'. Each tumbler assembly 50 with an outer pin 51 and an inner pin 52 is designed just like in the previous embodiment, the only difference being that the associated code patterns on the edge portion of the key blade 11' may fall partially outside the key blade material, if the key blade 11' is thin in relation to the dimensions of the tumbler assemblies. In this case, there may be a lower number of possible locations for the recess portions 12'*b* (see FIG. 2*c*), but the number of possible code combinations for each tumbler assembly 51, 52 will still be relatively large.

Figures 2, 2A, 2B, 2C:
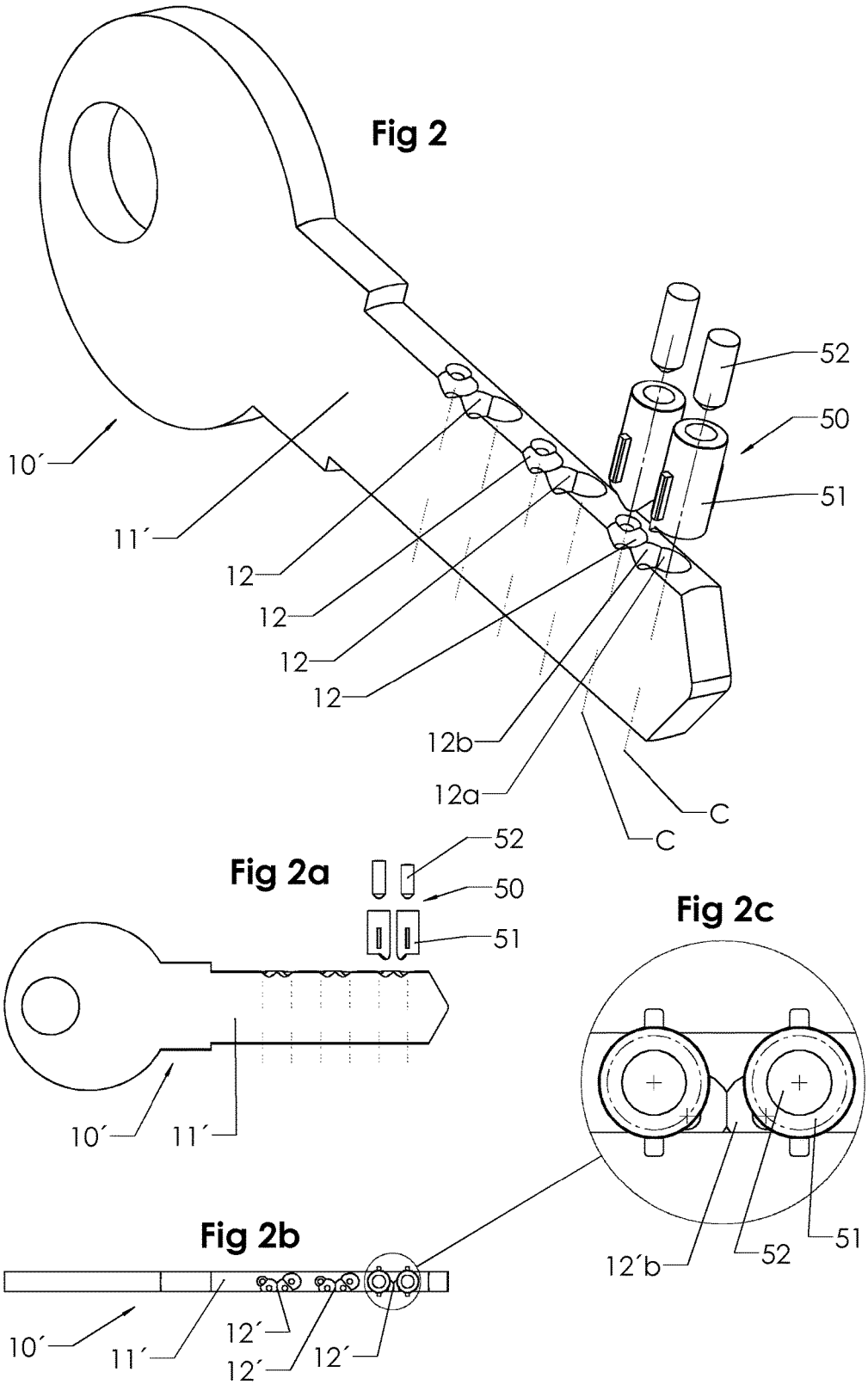
FIG. 2 is a perspective view of a second embodiment of a key according to the invention, where the code pattern is situated on an edge portion of the key blade.
FIG. 2*a* is a side view of the key and tumbler assembly shown in FIG. 2.
FIG. 2*b* is a top view of the key blade of FIGS. 2 and 2*a;*
FIG. 2*c* shows, in a larger scale, a portion of the code pattern on the edge portion of the key blade.
Figure 3B:
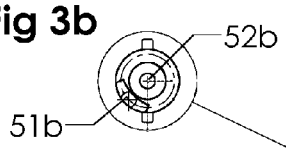
FIG. 3*b* is a top view of the tumbler assembly shown in FIG. 3.
Figure 3C:
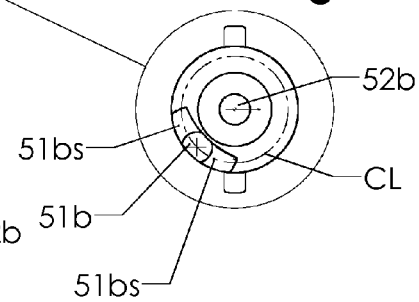
FIG. 3*c* shows the top view of FIG. 3*b* in a larger scale.
Figure 3:
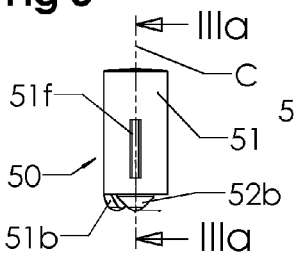
FIG. 3 is a side view of a tumbler assembly of the kind shown in FIG. 1 and FIG. 2.

FIGS. 3, 3*a*, 3*b* and 3*c* illustrate, separately, the tumbler assemblies shown in FIGS. 1 and 2. In FIG. 3, the outer pin 51 is visible, with its guiding member or fin 51*f* and its axially projecting lug 51*b*. The only visible part of the inner pin is the lower key contacting end portion or lug 52*b*. The latter is located on the centre-line C of the tumbler assembly.

Figure 3A:
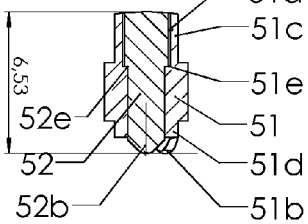
FIG. 3*a* is a longitudinal section through the tumbler assembly according to FIG. 3.
Figure 4B:
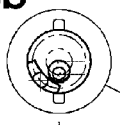
FIGS. 4, 4*a*, 4*b* and FIG. 4*c* are similar views as FIGS. 3, 3*a*, 3*b*, 3*c* of a modified embodiment having an inclined inner pin.
Figure 4C:
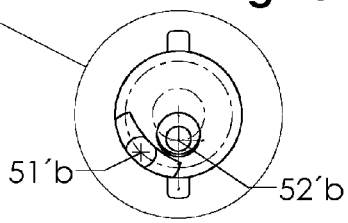
Figure 4A:
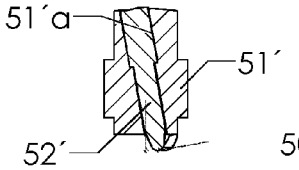
Figure 4:
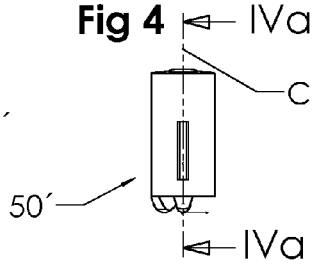

From the longitudinal section shown in FIG. 3*a*, it is seen that the upper, somewhat wider part of the inner pin 52 is guided by the cylindrical bore 51*a* in the upper part 51*c* of the outer pin 51. It is also evident that the inner and outer pins are movable axially together and that the outer pin 51 may be displaced downwards in relation to the inner pin 52. Thus, the axially projecting lugs 51*b* and 52*b* may be displaced axially, either together or relative to each other. It will be understood that the mutually engaging cylindrical surfaces of the inner and outer pins may be axially straight, as shown in FIGS. 1 and 2, or provided with shoulders which limit the relative axial movement. These shoulders 51*e* and 52*e* may be configured to limit the relative axial movement of the inner pin 52 either downwards (as shown) or upwards.

The relative locations of the axially projecting lugs 51*b* and 52*b* will also appear from FIGS. 3*b* and 3*c*. The axially projecting lug 52*b* of the inner pin 52 is in this case located on the centre-line C, whereas the axially projecting lug 51*b* on the outer pin 51 is situated at a coded location, with its pointed end positioned circumferentially somewhere along the circle line CL. The lug 52*b* is conical with a pointed or slightly rounded end 52*b*, whereas the lug 51*b* has gradually sloping portions 51*bs* on either side of the pointed or slightly rounded tip 51*b*. According to the present invention, the lug 51*b* is situated at a coded location, e.g. at one of a number of circumferentially well defined positions, along the circle line CL. The circumferential position represents one degree of freedom, whereas the axial positions of the lugs 51*b* and 52*b* provide two further degrees of freedom, thus providing a very large number of possible code combinations of each tumbler assembly 50.

As illustrated in FIGS. 4, 4*a*, 4*b* and 4*c*, the inner pin 52' of the tumbler assembly 50' may be slightly inclined relative to the centre-line C of the tumbler assembly. In this case, the cylindrical bore 51'*a* in the outer pin 51' is of course tilted accordingly. The inclinational angle may be 20° or less in relation to the centre-line C. Still, it will be possible to vary the code locations of the lugs 51*b* and 52*b* in the same manner as in the previous embodiment.

A similar effect is obtainable by way of the embodiment shown in FIGS. 5, 5*a*, 5*b* and 5*c*. Here the axially projecting lug 52"*b* is asymmetrically located along an inner circle CL2, whereas the axially projecting lug 51"*b* on the outer pin 51" is located somewhere on an outer circle line CL1. In this way, the number of code combinations will be even greater.

In FIGS. 6, 6*a*, 6*b* and 6*c* further components of the lock are shown, viz. a drive pin assembly 60 with an outer pin or sleeve 61 and an inner pin 62 arranged axially in line with the tumbler assembly 50 with the outer pin 51 and the inner pin 52. The drive pin assembly 60 is arranged in an associated bore in a surrounding, stationary housing of the lock (not shown), so that the abutting end surfaces of the tumbler assembly 50 and the drive pin assembly 60 are located at the shear line between the rotatable key plug and the surrounding lock housing. In this embodiment, an inner pressure spring 72 acts on the inner drive pin 62, whereas an outer pressure spring 71 acts on the outer drive pin 61. In this way, the drive pin assembly 60 will normally be located in a position which locks the key plug against rotation. Only when a correctly cut key is inserted into a key slot of the key plug (not shown), will it be possible to rotate the key plug by turning the inserted key.

FIGS. 7, 7*a*, 7*b* and 7*c* illustrate a similar embodiment, the differences being that the outer pin 51''' is provided with a widened cylindrical bore 51'''*a* accommodating a circumferential flange 52'''*f* on the inner pin 52'''. Also, the projecting lug 52'''*b* (see FIG. 7*c*) on the inner pin 52''' is asymmetric or radially displaced in a similar manner as in FIGS. 5, 5*a*, 5*b*, 5*c*.

A further embodiment of the tumbler assemblies 50' is shown in FIG. 8. Here, the inner pin 52 with its axially projecting lug 52*b* is similar to those shown in FIGS. 1 and 2. However, the outer pin 151 is provided with two opposite lower parts, i.e. one short part 151*s* and one longer part 151*l*. At their bottom ends, these parts are provided with axially projecting lugs 151*sb* and 151 1*b*, respectively. The shorter lugs 151*sb* cooperate with upper coded recesses 12"*b*, on the edge portion of the key blade 111', whereas the longer lugs 151 1*b* engage with coded recesses 120 cut into a shelf on the associated side of the key blade 11". The central lugs 52*b* on the inner pins 52 engage with code recesses 12"*a* on the edge of the key blade 111'.

As appears from FIG. 8*h* the shorter lugs 151*sb* may by located in various circumferential positions, e.g. two, three or four positions, on the circular portion CLs, whereas the longer lugs 151 1*b* may by positioned at a selected position along the circular portion CL1. It will be appreciated that this structure opens up for many code combinations. The engagement between the tumbler assembly and the key blade 11" will also appear from FIGS. 8*a*, 8*b*, 8*c*, 8*d*, 8*e*, 8*f*. FIGS. 8*d* and 8*e* show two embodiments with the longer projecting lug being oriented to the right and to the left, respectively. In FIG. 8*f* there is a third embodiment where the longer part of the outer pin 151 is provided with two different longer lugs 151' 1*c* and 151' 1*d*. In this embodiment (FIG. 8*f*) the two lugs may be coded in the same way as in WO2007/018456 (WINLOC AG), with one or the other, or both, of the longer lugs 151' 1*c* and 151' 1*d* engaging with an associated one of the coded recesses 120 on the shelf of the key blade 111'.

In FIGS. 8*i*, 8*k*, 8*l*, 8*m* and 8*n* there are shown some modified embodiments of the present invention.

Figure 8I:
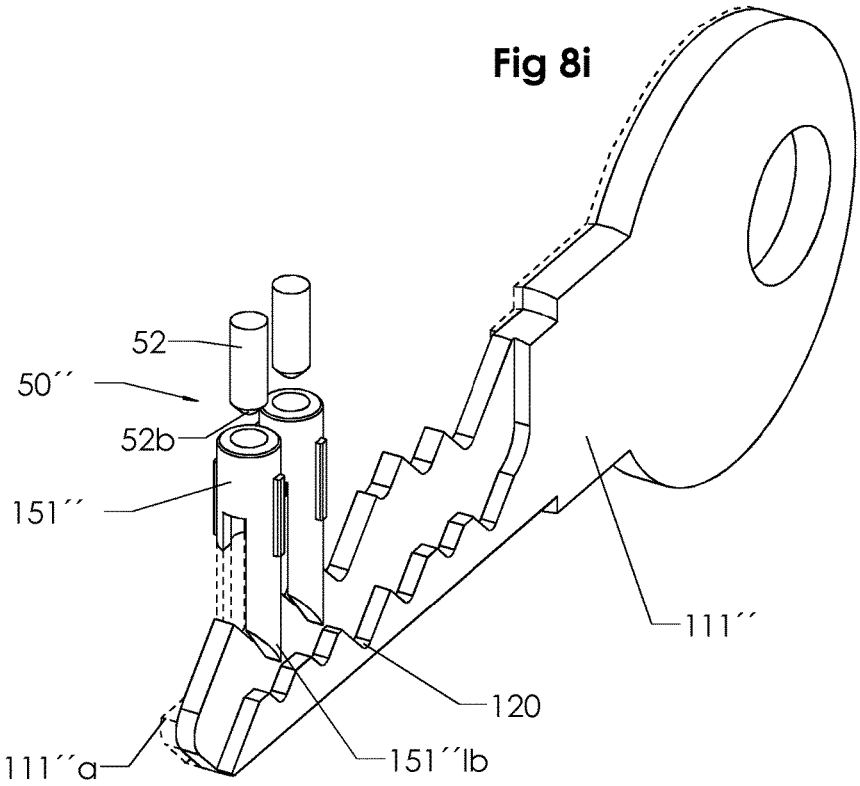
FIGS. 8*i*, 8*k*, 8*l*, 8*m* and 8*n* show two modified embodiments for a thin and a thick (dashed lines) key blade, respectively.
Figure 8K:
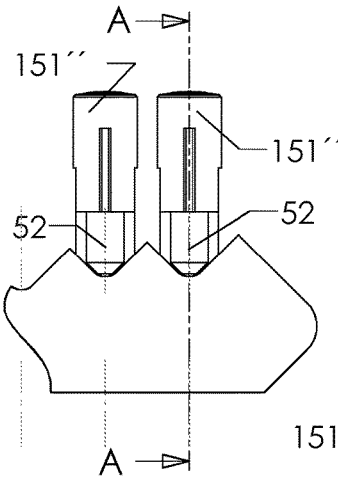
Figure 8L:
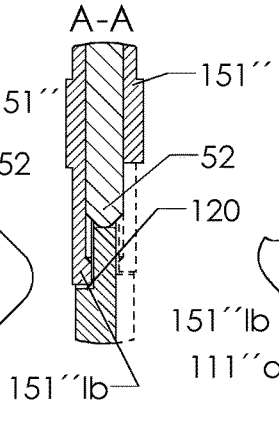

The key blade 111" may be somewhat thinner (without the dashed portion on the back side as seen in FIG. 8*i*). If so, the outer pin 151" will only have one axially projecting lug, a long lug 151" 1*b* (compare FIGS. 8*k* and 8*l*).

Figure 8M:
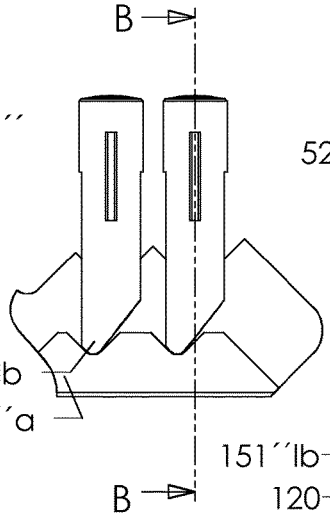
Figure 8N:
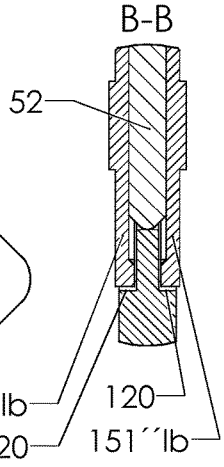

On the other hand, if the key blade is thick (as in the previous embodiments), there is room for a code pattern with coded recesses 120 on the back side 111"*a* as well, and long lugs 151" 1*b* branching down on both sides of the key blade 111", as shown in FIGS. 8*m* and 8*n*. It should be pointed out that it is just a coincident that the two long lugs 151" 1*b* in FIG. 8*n* have the same lengths. Generally, they are of different lengths, being dependent on the particular depths of the recesses 120.

In FIGS. 9*a*, 9*b*, 9*c*, 9*d*, 9*e* and 9*f*, the tumbler assembly 50', and the associated tumbler drive assembly 60', and the spring assembly 70' (of the embodiment shown in FIGS. 8 through 8*d*) are shown as such, without the engaging key being illustrated.

In the embodiment shown in FIGS. 10, 10*a*, 10*b*, 10*c* and 10*d*, the key 10 with the key blade 11 and the coded recess portions 12 is similar to the embodiment shown in FIG. 1, although each code pattern 12 comprises a centrally located recess portion 12*a* and two adjoining recess portions 12*b* and 12*c* each accommodating a lug 51*b*, 51*c* on the outer pin 51. The central recess portion 12*a* is adapted to receive the axially projecting lug 52*b* on the inner pin 52, this lug 52*b* being located on the centre-line C. The locations of the three lugs 51*b*, 51*c* and 52*b* appear best from FIG. 10*d*. In this embodiment, the two lugs 51*b*, 51*c* are located opposite to each other on the circle line CL. However, these two lugs may be positioned at any two distinct points along the circle line CL (less than 180° apart). It will be appreciated that there is a very high number of possible code locations for these three lugs 51*b*, 51*c* and 52*b*.

Figure 5B:
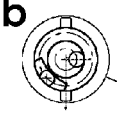
FIGS. 5, 5*a*, 5*b* and 5*c* are similar views of a further embodiment, where the inner pin has an asymmetric end portion.
Figure 5C:
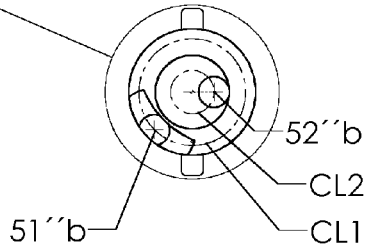
Figure 5A:
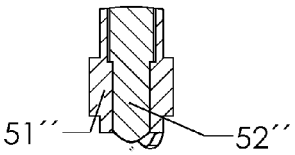
Figure 5:
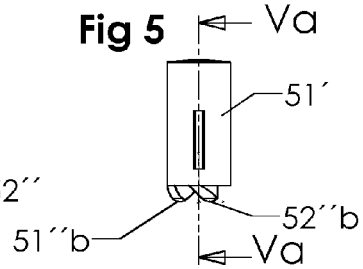

The tumbler assembly 50 shown in FIGS. 11*a*, 11*b*, 11*c*, 11*d*, 11*e*, 11*f*, 11*g* and 11*h* resembles the one shown in FIGS. 5-5*c*, with one lug 51*b* on the outer pin 51 and another lug 52*b* on the inner pin 52. However, in this case, the inner pin 52 has a radially offset flange 52*a* which is provided with the axially projecting lug 52*b* (see FIG. 11*e*). In order to make room for the offset flange 52*a*, the second or lower part 51*d* of the outer pin 52 extends only partly in the circumferential direction, leaving a free space axially adjacent to the first or upper part 51*c*.

With such a structure, the projecting lug 52*b* on the inner pin 52 may be located at the same radial distance from the centre-line C on the circle line CL, as can be seen from the FIGS. 11*c*, 11*d*, 11*g*, 11*h*. Accordingly, each of the lugs 51*b* and 52*b* may be located at any circumferential position on a semi-circle (half of the circle line CL). In this case, there is no coded recess portion on the centre-line C.

The invention claimed is:

1. A cylinder lock and key combination, comprising:

a key with an elongate key blade, having at least one code pattern with coded recessed portions, and a lock having a rotatable key plug with a key slot and at least one dual tumbler assembly for locking the key plug against rotation, each said at least one dual tumbler assembly including:

an outer pin which is movable elevationally in a chamber in the key plug, wherein said outer pin is composed of a first or upper part, formed by a cylindrical sleeve portion defining, at the inside thereof, a cylindrical bore, which extends along an axis thereof, and a second or lower part being provided with a circumferential, circular surface portion and at least one key contacting axially projecting eccentric outer lug, which projects axially from said circumferential, circular surface portion in parallel to said axis, said circumferential, circular surface portion also being coaxial in relation to a centerline of said at least one dual tumbler assembly, and an inner pin, which is movable telescopically in said cylindrical bore of said outer pin, wherein a first or upper portion of said inner pin is cylindrical and is dimensioned for axial, guided movement within said cylindrical bore of said first or upper part of said outer pin, substantially along said centerline of the at least one dual tumbler assembly, and a second or lower portion of said inner pin is provided with at least one key contacting inner lug, wherein said at least one key contacting axially projecting eccentric outer lug and said at least one key contacting inner lug of said outer and inner pins of said at least one dual tumbler assembly are located adjacent to each other at axially and radially well-defined code positions relative to said centerline of said at least one dual tumbler assembly, wherein the code position of said at least one key contacting axially projecting eccentric outer lug of said outer pin is situated at a selected circumferentially coded location on said circumferential, circular surface portion, relative to said centerline of the at least one dual tumbler assembly, at a predetermined distance outwardly from said centerline, said at least one key contacting axially projecting eccentric outer lug of the outer pin being provided with gradually sloping portions extending in the circumferential direction on both sides of a tip thereof, and wherein the selected circumferentially coded location and a depth of said at least one key contacting axially projecting eccentric outer lug of the outer pin and a depth of said at least one key contacting inner lug of the inner pin are selectively positioned in accordance with first, second and third codes within coded recessed portions of said at least one code pattern on the key blade and have three degrees of freedom, when the key blade is being inserted into the key slot of said key plug of the lock, said three degrees of freedom including:

1) the axial position of said at least one key contacting axially projecting eccentric outer lug of the outer pin within an outer recessed portion of said at least one code pattern on the key blade, the depth of said outer recessed portion being at a first level and forming a first code;

2) the circumferential location of said at least one key contacting axially projecting eccentric outer lug of the outer pin along said circumferential, circular surface portion and within said outer recessed portion of said at least one code pattern on the key blade, the circumferential location of said outer recessed portion forming a second code; and 3) the axial position of the at least one key contacting inner lug of the inner pin within an inner recessed portion of said at least one code pattern on the key blade, the depth of said inner recessed portion being at a second level, said second level being generally a different value relative to the depth of said outer recessed portion at the first level, and forming a third code.

2. The lock and key combination as defined in claim 1, wherein the entire length of said inner pin extends along said centerline of said at least one dual tumbler assembly.

3. The lock and key combination as defined in claim 2, wherein the at least one key contacting projecting lug of said inner pin is conical and protrudes axially on said centerline of said at least one dual tumbler assembly.

4. The lock and key combination as defined in claim 1, wherein said second or lower part of said outer pin comprises a cylindrical wall which extends only partly in the circumferential direction, leaving a circumferential free space adjacent to said first or upper part, and wherein said second or lower portion of said inner pin is extended radially outwardly into said free space.

5. The lock and key combination as defined in claim 1, wherein said at least one key contacting inner lug of said inner pin protrudes axially but is offset radially from said centerline of said at least one dual tumbler assembly.

6. The lock and key combination as defined in claim 5, wherein said inner pin is composed of said first or upper cylindrical portion, extending along said centerline, and a second or lower portion having a radially offset flange provided with at least one axially protruding key contacting projecting lug.

7. The lock and key combination as defined in claim 1, wherein said inner pin is arranged at an angle, not exceeding 20°, relative to a centerline of said at least one dual tumbler assembly.

8. The lock and key combination as defined in claim 1, wherein said outer pin is provided with at least one radially outwardly projecting member which prevents the outer pin from rotating around said centerline of said chamber.

9. The lock and key combination as defined in claim 1, wherein said outer and inner pins are movable axially together, one of them being movable a limited distance relative the other one.

10. The lock and key combination as defined in claim 1, wherein said outer pin has at least two, key contacting axially projecting end portions with associated eccentric lugs, located at different circumferential positions on an associated circular surface portion and each at a radial distance from said centerline, wherein said at least one dual tumbler assembly is provided with at least three key contacting end portions.

11. The lock and key combination as defined in claim 1, wherein said inner pin is arranged to cooperate with code portions located on an edge portion of said key blade, whereas said at least one key contacting axially projecting eccentric lug of said outer pin is arranged to cooperate with an associated code portion on a side shelf of said key blade.

12. The lock and key combination as defined in claim 11, wherein the outer pin has two opposite second or lower parts, each having a key contacting axially projecting eccentric lug cooperating with an associated code portion on the key blade.

13. The lock and key combination as defined in claim 12, wherein said opposite second or lower parts consist of one relatively long part cooperating with a code portion at the lower half of the key blade and one relatively short part cooperating with a code portion at the upper half of the key blade.

14. The lock and key combination as defined in claim 13, wherein said opposite second or lower parts consist of one relatively long part cooperating with a code portion at the lower half of the key blade and one relatively short part cooperating with a code portion at the upper half of the key blade and wherein said relatively long part is provided with two key contacting eccentric lugs, the extreme ends of which are separated from each other in the longitudinal direction of said key plug.

15. The key for use with a lock and key combination as defined in claim 1, said key having an elongate key blade provided with said at least one code pattern having an outer recessed portion configured to engage said gradually sloping portions extending in the circumferential direction and an inner recessed portion, said first code being the depth of said outer recessed portion at said first level, said second code being the circumferential location of the outer recessed portion for engaging said axially projecting eccentric outer lug of the outer pin and said third code being the depth of said inner recessed portion at said second level.

* * * * *